US009061199B2

(12) United States Patent
Tripp et al.

(10) Patent No.: US 9,061,199 B2
(45) Date of Patent: Jun. 23, 2015

(54) BALL DELIVERY DEVICE, SYSTEM, AND METHOD

(71) Applicants: Warren Tripp, Reno, NV (US); Bryan Born, Sparks, NV (US); Ray Duer, Sparks, NV (US); Al Grinsell, Reno, NV (US); Michael Hall, Sparks, NV (US); Ken Juenke, Reno, NV (US); Rick Smith, Reno, NV (US); Matt Walsh, Reno, NV (US)

(72) Inventors: Warren Tripp, Reno, NV (US); Bryan Born, Sparks, NV (US); Ray Duer, Sparks, NV (US); Al Grinsell, Reno, NV (US); Michael Hall, Sparks, NV (US); Ken Juenke, Reno, NV (US); Rick Smith, Reno, NV (US); Matt Walsh, Reno, NV (US)

(73) Assignee: TRIPP ENTERPRISES, INC., Reno, NV (US)

( * ) Notice: Subject to any disclaimer, the term of this patent is extended or adjusted under 35 U.S.C. 154(b) by 0 days.

(21) Appl. No.: 14/268,175

(22) Filed: May 2, 2014

(65) Prior Publication Data

US 2015/0045103 A1 Feb. 12, 2015

Related U.S. Application Data

(60) Provisional application No. 61/864,471, filed on Aug. 9, 2013.

(51) Int. Cl.
*G07F 17/32* (2006.01)
*A63F 3/06* (2006.01)

(52) U.S. Cl.
CPC ..... *A63F 3/0645* (2013.01)

(58) Field of Classification Search
CPC ... G07F 17/32; A63F 3/00157; A63F 3/0645; A63F 9/0468
USPC ..... 463/19, 22
See application file for complete search history.

(56) References Cited

U.S. PATENT DOCUMENTS

2004/0204225 A1* 10/2004 Campo et al. ..... 463/19
2006/0247019 A1* 11/2006 Watkins ..... 463/22

* cited by examiner

*Primary Examiner* — Pierre E Elisca
(74) *Attorney, Agent, or Firm* — Michael A. Kerr; Kerr IP Group, LLC

(57) ABSTRACT

A ball delivery device, system, and method housing a plurality of balls for a game session is presented. The ball delivery device includes a mixing chamber, at least one instruction to start the game session, an identifier, at least one arm, a ball holder, a reader and a tube. The mixing chamber receives the balls for the game session. After receiving an instruction to begin the game session, balls are singly drawn from the mixing chamber. The identifier disposed on each ball uniquely identifies each ball. The arm mixes the balls in the mixing chamber. The ball holder disposed on the arm holds a single ball that is randomly selected from the mixing chamber. The reader reads the identifier of the ball selected by the ball holder. The tube receives each selected ball and holds the selected balls after the identifier reads the ball and until completion of the game session.

22 Claims, 8 Drawing Sheets

BALL DELIVERY DEVICE, SYSTEM, AND METHOD

CROSS REFERENCE

This patent application claims the benefit of provisional patent application 61/864,471 filed on Aug. 9, 2013 entitled AUTOMATED BINGO SYSTEM AND METHOD, which is hereby incorporated by reference in its entirety.

FIELD OF THE INVENTION

The present invention relates to a ball delivery device, system, and method. More specifically, the invention relates to a ball delivery gaming device that randomly draws balls, reads the balls, and then deposits the balls into a tube during a game session.

BACKGROUND

Bingo is a game of chance played with randomly drawn numbers, in which players match selected numbers against numbers that have been pre-printed on 5×5 matrices. The matrices may be printed on paper, card stock, or electronically represented and are referred to as cards. Many versions conclude the game when the first person achieves a specified pattern from the drawn numbers. The winner is usually required to call out the word "Bingo," thereby alerting the other players and the caller of a possible win. All wins are checked for accuracy before the win is officially confirmed. Subsequently, the prize is secured by the winning player and a new game begins. In this illustrative version of bingo, players compete against one another for the prize or jackpot.

Modern bingo has evolved into multiple variations, with each jurisdiction's gambling laws regulating how the game is played. There are also nearly unlimited patterns that may be specified for play. Some patterns only require one number to be matched, while others are cover-all games that award the jackpot for covering an entire card, and other games award prizes to players for matching no numbers or achieving no pattern.

The most common bingo cards are flat pieces of cardboard or disposable paper that contain 25 squares arranged in five vertical columns and five horizontal rows. Each space in the grid contains a number, with the exception of the center space, which is usually marked "free" or "free space," and is considered automatically filled.

A typical bingo game utilizes the numbers 1 through 75. The five columns of the card are labeled 'B', 'I', 'N', 'G', and '0' from left to right. The range of printed numbers that can appear on the card is normally restricted by column, with the 'B' column only containing numbers between 1 and 15 inclusive, the 'I' column containing only 16 through 30, 'N' containing 31 through 45, 'G' containing 46 through 60, and '0' containing 61 through 75.

During some variants of bingo, players are issued three 25-number cards which contain all 75 numbers that may be drawn. Players mark which numbers they wish to play, and then daub those numbers according to the numbers drawn. In addition, double-action cards have two numbers in each square.

A player wins by completing a row, column, or diagonal. The most chips one can place on a bingo board without having bingo is 19, not counting the free space. In order for this to happen, only one empty cell can reside in each row and each column, and at least one empty cell must be in each diagonal.

In addition to a straight line, many bingo halls may consider other patterns as a valid bingo. For example, a 2×2 square of marked squares in the upper right-hand corner would be considered a "postage stamp." Another common special game requires players to cover the four corners. There are several other patterns, such as a Roving 'L' which requires players to cover all B's and top or bottom row or all O's and top or bottom row. Another common pattern is a blackout, covering all 24 numbers and the free space.

The numbers which are called in a game of bingo may be drawn utilizing a number of methods to randomly generate the ball call. With the expansion of computer technology in bingo, electronic random number generators are now commonplace in most jurisdictions. However, some jurisdictions require mechanical ball draws that may utilize a randomly shuffled deck of bingo calling cards, a mechanical ball blower that mixes ping pong balls with blown air, or a cage which is turned to mix small wooden balls. All methods essentially generate a random string of numbers that players match to their bingo cards.

Keno is another lottery style game that also draws balls. Players wager by marking an "S" over the "spot" choices on a blank keno ticket form with 80 numbered selection boxes (1 to 80). After all players successfully place their wagers, the casino draws 20 balls (numbers) at random. Some casinos automatically call the ball draw at preset timed intervals regardless of whether or not players are waiting to place a wager.

The ball draw in keno occurs at the keno booth. The ball draw is typically determined by one of four devices that include a traditional "Rabbit Ear" blower; an automated blower in which the balls are encoded and read by a computer; a random number generator; and a hand cage that includes a spinning metal ball cage which rolls the numbers into a slot where they are validated by a person.

Keno runners walk around calling, "keno!" and offer to carry players' wagers to the keno booth for processing. The keno runner is handed the wager payment and the "inside ticket" (keno wager forms filled out by the customer) and takes the wager and ticket to the keno counter for processing. The keno runner returns with an "outside" ticket, which is the official wager receipt.

After picking wager numbers, recording them at the keno booth and obtaining the "keno ticket" (official wager receipt), the player watches the ball draw in progress as the spot (number) selections light either on an electronic keno board or on a video monitor. Keno displays are typically found throughout the casino and sometimes even appear on a television channel in casino hotel rooms.

SUMMARY

A ball delivery device, system, and method housing a plurality of balls for a game session is described. The ball delivery device includes a mixing chamber, at least one instruction to start the game session, an identifier, at least one arm, a ball holder, a reader, and a tube. The mixing chamber receives the plurality of balls for the game session. The game session is initiated when at least one instruction is received. The game session includes a plurality of game events, in which a smaller group of game events are each associated with drawing a ball from the mixing chamber during the game session. The identifier is disposed on each ball and uniquely identifies each ball. The arm mixes the balls in the mixing chamber. The ball holder is disposed on the arm and holds a single ball that is randomly selected from the mixing chamber. The reader reads the identifier of the ball selected by the ball holder. The tube receives each selected ball and holds the selected balls after the identifier reads the ball and until completion of the game session.

In one illustrative embodiment, the arm includes a fin that mixes the balls in the mixing chamber and the ball holder holds the single ball when the arm turns. In another illustrative embodiment, the arm selects one ball and mixes the balls in the mixing chamber when the arm turns clockwise, and the arm mixes the ball in the mixing chamber when the arm turns counterclockwise. In another illustrative embodiment, multiple arms are fixedly coupled to a hub which is operatively coupled to a motor that turns the arms.

In yet another embodiment, a release mechanism releases the balls held in the tube after the completion of each game session. In a further embodiment, a vertical panel is adjacent to the mixing chamber and includes the tube that receives the selected balls. In a still further embodiment, the ball delivery device includes a securing device that controls access to the balls housed in the automated gaming device so that the balls cannot be accessed during the game session.

In yet a further illustrative embodiment, the ball delivery device includes a user interface that receives the instruction for initiating the game session. In yet another illustrative embodiment, the ball delivery device includes a static removal component that further includes an ION CORD™.

A method for operating a ball delivery system housing a plurality of balls for a game session is also described. The method receives the plurality of balls in a mixing chamber for the game session. The method then proceeds to receive at least one instruction to start the game session that includes a plurality of game events, in which a smaller group of game events are each associated with drawing a ball from the mixing chamber during the game session. The method then identifies each ball with a unique identifier disposed on the ball. The balls are then mixed in the mixing chamber with at least one arm. A ball holder disposed on the arm holds a single ball that is randomly selected from the mixing chamber. The method then proceeds to read the identifier of each ball that is selected by the ball holder. Each of the selected balls is then received in a tube until completion of the game session.

By way of example and not of limitation, the game session includes a bingo game session with a plurality of bingo game events. In another illustrative example, the game session includes a keno game session with a plurality of keno game events.

DRAWINGS

The present invention will be more fully understood by reference to the following drawings which are for illustrative, not limiting, purposes.

DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus and systems described herein may vary as to configuration and as to details. Additionally, the methods may vary as to details, order of the actions, or other variations without departing from the illustrative method disclosed herein.

The automated gaming device, system, and method described herein allows the random drawing of balls from a mixing chamber that are then read by a reader and deposited in a tube during a game session. In the illustrative embodiment presented herein, the illustrative game is a bingo game. However, other games may also be played on the automated gaming device including lottery games, keno games, online bingo games, pakapoo, and other such "lottery-style" games.

More generally, a lottery-style game includes a plurality of players that each receive a ticket or card and then await a random drawing of one or more "symbols" to determine whether there is a match between the player's ticket or card and the randomly selected symbol(s). If there are sufficient matches between the randomly selected symbols and symbols on the player's ticket or card, then the first player to achieve a match according to the game rules is awarded a prize. By way of example and not of limitation, the symbols are numbers, but they may also be images, alphabetic symbols, alphanumeric symbols, or any combination thereof.

The automated gaming device presented herein overcomes various disadvantages of lottery-based gaming devices and systems. For example, one disadvantage of existing bingo mixing machines is that the balls are drawn out of the machine by the person reading the bingo balls. After play, the bingo balls are returned to the mixing chamber. However, cheating may occur when balls which are removed from the mixing chamber are not returned to the mixing chamber, or when additional balls are returned to the mixing chamber. This changes the odds of winning or losing. To avoid cheating, for example, in a lottery, there must be several personnel watching each other to ensure that balls are not added or removed from the total ball count.

Figure 1:
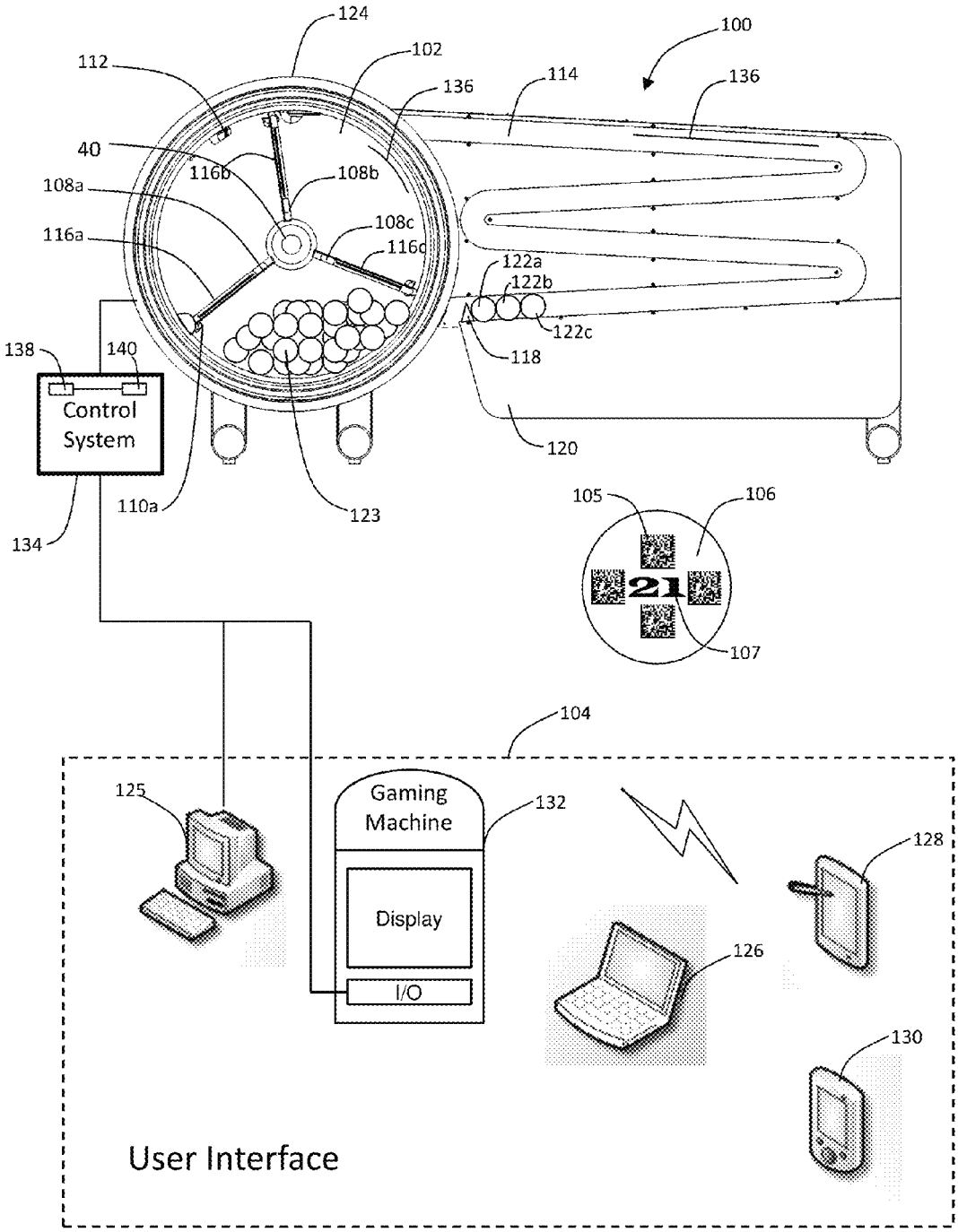
FIG. 1 shows an illustrative automated gaming device and system.

Referring to FIG. 1, there is shown an illustrative automated gaming device and system. The automated gaming device 100 includes a mixing chamber 102, a user interface 104 on a computing device, an identifier 105 on each ball 106, an arm 108, a ball holder 110, a reader 112, and a tube 114. The mixing chamber 102 receives a plurality of balls 123. The user interface 104 receives at least one instruction to start a game session. The balls are drawn from the mixing chamber 102 during the game session. Each ball includes an identifier 105 that uniquely identifies the ball. The arm 108 mixes the balls in the mixing chamber 102. The arm includes a ball holder 110 that holds a single ball that is randomly selected from the mixing chamber 102. The reader 112 reads the identifier of the ball that is selected by the ball holder 110. After the ball identifier is read by the reader 112, the tube 114 receives each selected ball and holds the selected balls until completion of the game session.

The illustrative arm 108 of the automated gaming device includes a fin 116 that is configured to mix the balls in the chamber. In the illustrative embodiment, there are three arms 108*a*, 108*b* and 108*c* that are fixedly coupled to a hub 40 that is operatively coupled to a motor that turns the arms that cause the balls in the mixing chamber 102 to move about randomly.

In operation, there are two illustrative mixing modes. The first illustrative mixing mode is a "premixing" mode, in which the mixer rotates in a counterclockwise fashion that does not capture or hold any balls in the ball holder. The premixing mode may be initiated after a set of balls enter the mixing chamber, between game sessions, or during a game session. During the premixing mode, balls are not selected or held by the ball holder.

The second illustrative mixing mode is a "capture" mode, in which the hub moves in a clockwise fashion and as the arms mix the balls 123, the ball holder corresponding to a particular arm holds a selected ball in the ball holder. In the illustrative embodiment, each of the arms is configured to hold a single ball that is randomly selected, the ball is read by reader 112, and then deposited into tube 114. In the illustrative embodiment, the capture mode is repeated until the game session is completed. The particular rotation, i.e. clockwise or counterclockwise, of the arm for the corresponding premixing mode and capture mode is a design choice that may be alternated.

A game session includes a plurality of game events, in which each game event is associated with the rules of the particular game. By way of example and not of limitation, a game event may include randomly drawing a ball, mixing the balls 123, awarding a prize, and other such events that make up the game session including, but not limited to, receiving user instructions and performing the particular user instruction during the game session as described herein.

Additionally, the illustrative automated gaming device 100 includes a release mechanism 118 that releases the balls held in the tube 114 after the completion of each game session. Furthermore, the automated gaming device 100 includes a vertical panel 120 adjacent to the mixing chamber. The vertical panel 120 also includes the tube 114 that receives the selected balls 122*a*, 122*b* and 122*c*. The illustrative tube 114 includes three U-shaped curvatures through which captured balls travel toward the bottom of the tube. The automated gaming device also includes a securing device 124 that controls access to the balls housed in the automated gaming device.

The user interface 104 can be disposed on one of the many illustrative devices that are configured to display a user interface that receives instruction that initiate each game event of the game session. By way of example and not of limitation, the wired or wireless devices include, but are not limited to, a personal computer 125, a laptop 126, a tablet computer 128, a Smartphone 130, a gaming machine 132 such as a slot machine, and other such networkable client devices. The illustrative wired or wireless device may be communicatively coupled to a control system 134 with a wired or wireless connection. By way of example and not of limitation, the wireless connection may rely on IR communication or may use Wi-Fi, Bluetooth, or other such wireless communication standards. By way of example and not of limitation, the wired connection may utilize such networking standards as Ethernet.

The illustrative control system 134 manages the operations performed by ball delivery device. By way of example and not of limitation, the control system 134 includes a processor 138 communicatively coupled to a memory 140. The control system 134 receives instructions from one of the user interface devices 104. The user interface devices 104 receive instructions that help manage or control the game session. In operation, the illustrative user interface 104 may be embodied in a touch screen user interface on a wired or wireless device that is communicatively coupled to the ball delivery device.

An illustrative ball 106 is presented with identifiers printed thereon. More specifically, the illustrative ball 106 may include four identifiers 105 surrounding a numeric or alphanumeric symbol 107. Additionally, the illustrative ball 106 may include six numeric or alphanumeric symbols and a corresponding 24 identifiers.

The ball delivery device, system, and method presented herein may be applied to a variety of different lottery-style casino games that use balls to generate the random outcomes. The illustrative lottery-style casino games that utilize the ball delivery device include, but are not limited to, bingo and keno. In an illustrative bingo game that is played in the United States there are 75 balls. In other countries, there are 90 balls in an illustrative bingo game. For an illustrative keno game, there are 80 balls. The number of balls in a mixing chamber at the beginning of each game session varies according to the game rules. Thus, one illustrative lottery game may use 65 balls and another illustrative lottery game may use 67 balls without having to substantially modify the ball delivery components.

During a game session, the ball interactions in the mixing chamber may build up a static charge. Anti-static sprays and additives may be applied to the balls to reduce the static charge build up. The anti-static sprays operate by attracting moisture from the air and making surfaces slightly conductive, so that surfaces are conductive to a ground.

Static electricity may also be removed by integrating a static removal component 136 that is integrated into the ball mixing device. By way of example and not of limitation, the static removal component includes a passive neutralizer such as the ION CORD™ that is tied to a grounded object. The illustrative static removal component 136 may be disposed in or near the mixing chamber, along the tube, or any other location in the ball mixing device. The static removal component 136 may also be an inductive neutralizer which induces a charge on a sharp point of conductive material, causing the static electric field to become concentrated at the point. The static point causes the electric field to become sufficiently concentrated to remove electrons from air molecules, create ions, and allow the static charge to dissipate along a ground.

Figure 2A:
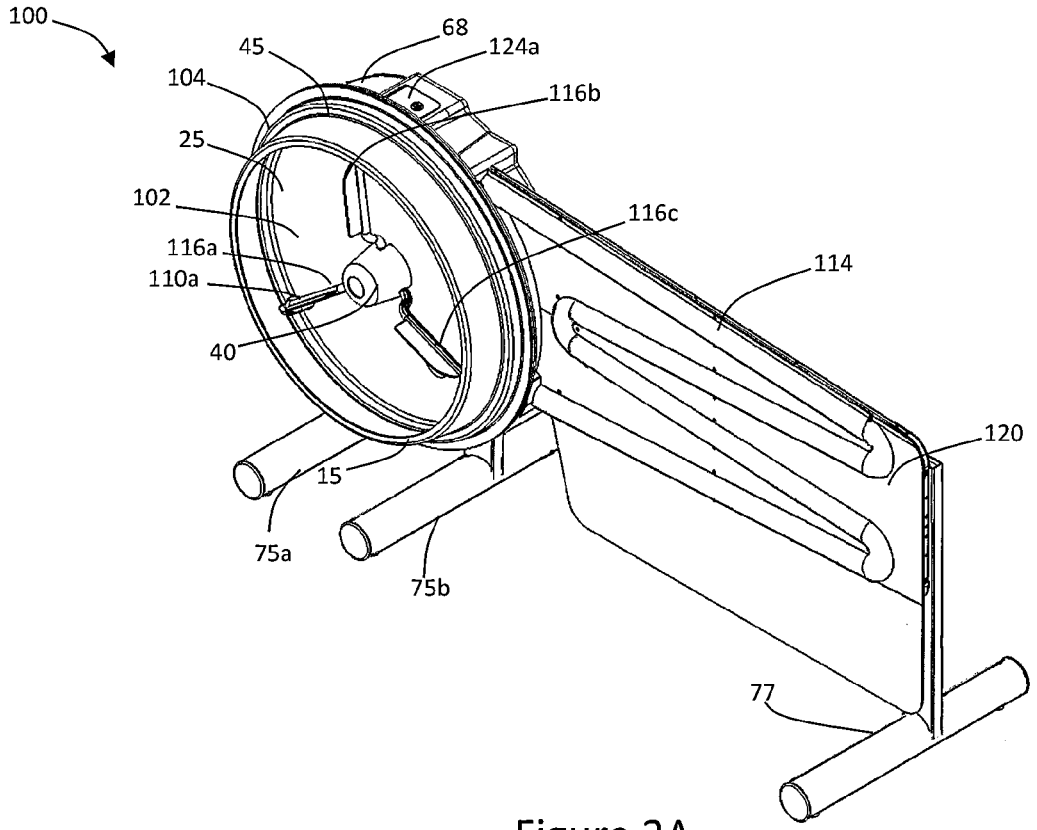
FIG. 2A shows an isometric view of the illustrative mechanical components.
Figure 2B:
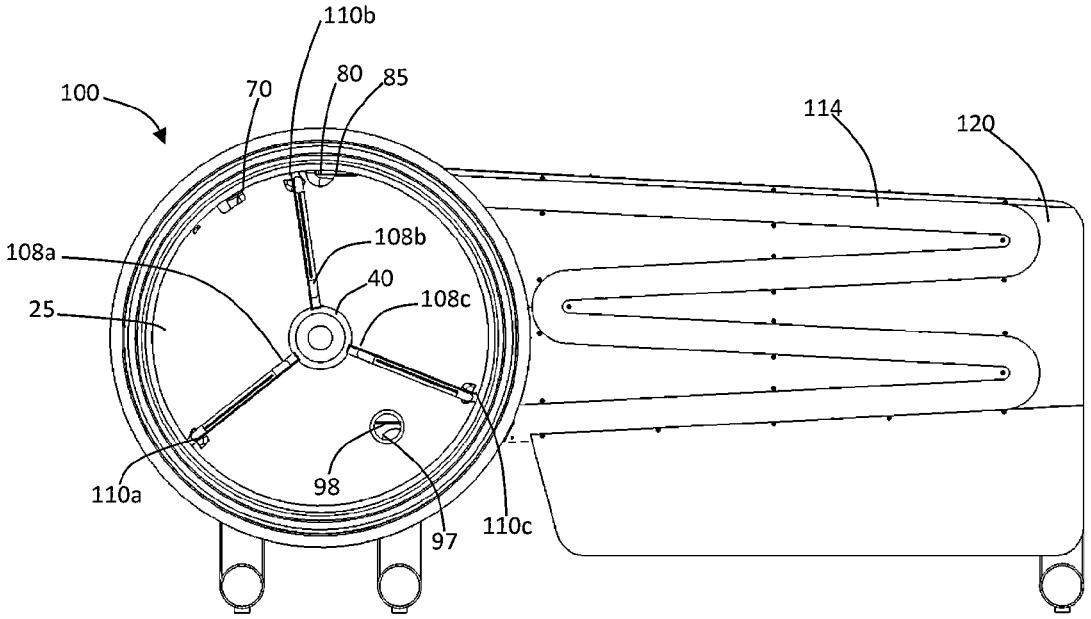
FIG. 2B shows a front view of the illustrative mechanical components.
Figure 2C:
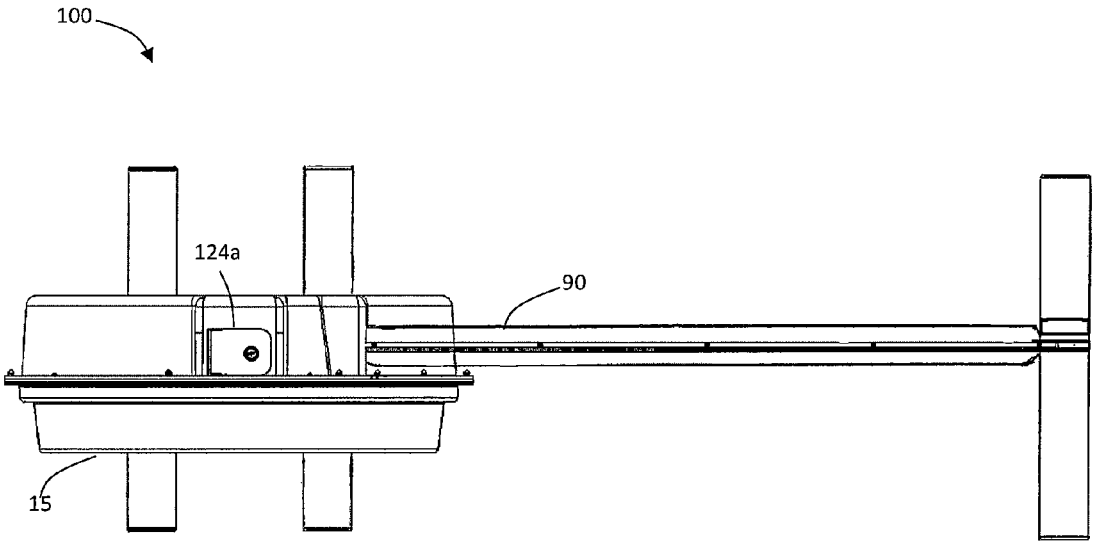
FIG. 2C shows a top view of the illustrative mechanical components.
Figure 2D:
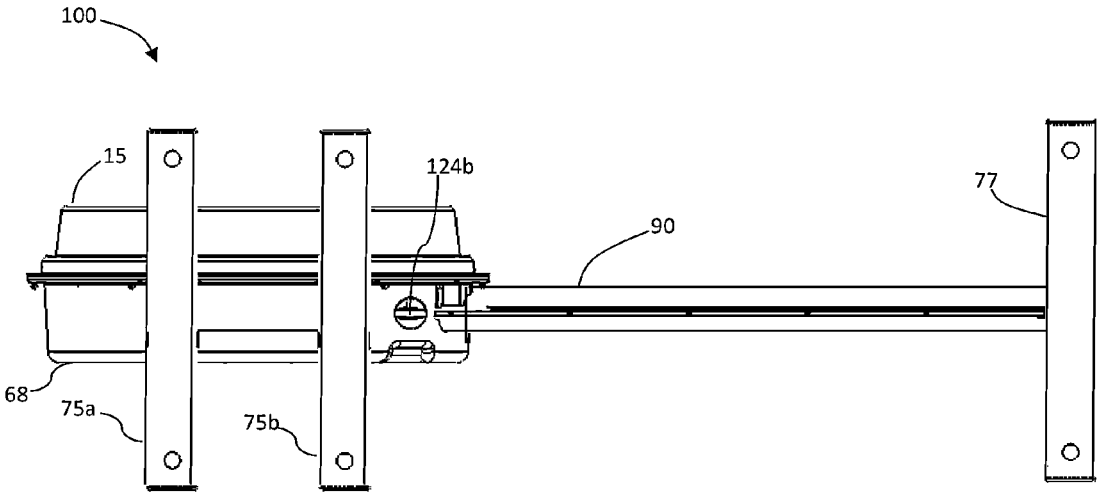
FIG. 2D shows a bottom view of the illustrative mechanical components.

Referring to FIGS. 2A, 2B, 2C and 2D, there are shown more detailed views of the mechanical components associated with the illustrative automated gaming device. More specifically, FIG. 2A provides an isometric view of the illustrative mechanical components. FIG. 2B provides a front view of the illustrative mechanical components. FIG. 2C is a top view of the illustrative mechanical components. FIG. 2D provides a bottom view of the illustrative mechanical components.

Referring to FIG. 2A, there is shown the ball delivery device 100 that includes a mixing chamber 102 that houses a plurality of bingo balls 123 (shown in FIG. 1). The mixing chamber 102 has a first front surface 15, a second front surface 25, and a back cover 68 (shown in FIG. 4A). The back surface 35 is disposed behind back cover 68. Mixing chamber 102 also includes a cylindrical surface 45 that extends from the second front surface 25 to the first front surface 15.

The mixing chamber 102 is bounded by cylindrical surface 45, first front surface 15, and second front surface 25. In the illustrative embodiment, the first front surface 15 is translucent so players can view balls through first front surface 15. The cylinders 75*a*, 75*b*, and 77 are welded to the automated gaming device and provide support for the ball delivery device.

When the game session is completed the ball release channel 97 (shown in FIG. 2B) is opened and the balls in tube 114 are released into the mixing chamber. In the illustrative embodiment, the ball release channel 97 extends through the second front surface 25 and is fixedly coupled to tube 114.

In operation, a ball release arm 98 (shown in FIG. 2B) disallows balls from entering tube 114 when ball release arm 98 is in a closed position. An illustrative ball release solenoid is configured to push the ball release arm 98 to an open position that allows the balls in tube 114 to be released into mixing chamber 102. After the balls exit tube 114, the ball release solenoid returns to its initial position and the ball release arm 98 returns to a closed position. The ball release process may be automated or may be controlled by an operator accessing the user interface.

Referring to FIG. 2B, there is shown the second front surface 25, a ball capture opening 80, and the ball release channel 97. The illustrative automated gaming device also includes one or more mixing arms 108*a*, 108*b* and 108*c*, where each mixing arm includes a ball holder component 110 at the end of the mixing arm that is furthest from hub 40. Each of the arms includes a fin 116*a*, 116*b*, and 116*c* (shown in FIG. 2A) along the length of arm that facilitates mixing the bingo balls in the mixing chamber 102. Each mixing arms 108*a*, 108*b* and 108*c* includes a ball holder 110*a*, 110*b*, and 110*c*, respectively. Each ball holder is configured to hold a single ball. The mixing arms 108 are fixedly coupled to a hub 40, which is rotated by a motor (not shown) that turns the mixing arms 108. In another illustrative embodiment, the ball holder at the end of mixing arm may only reside on one of the three mixing arms and the other two arms do not include ball holders so they are only for mixing purposes.

The number of mixing arms may vary according to design considerations. Additionally, whether a particular mixing arm includes a ball holder is also subject to design considerations. For example, a two-arm ball delivery device includes two alternative embodiments, in which the first embodiment further includes a ball holder disposed on the first arm and no such ball holder on the second arm. In a second two-arm embodiment, both arms include a ball holder. The number of arms is a design choice that can generally vary from one arm to six or more arms. Typically, the arc that separates the arms is the same. In operation, more ball holding arms would generally speed the game session because more balls would be selected during a 360° spin.

Referring to FIG. 2C, there is shown a top view of the exterior of the automated gaming device. By way of example and not of limitation, a first securing device 124*a* is shown that includes a top locking cover that may be attached to the back cover 68 (shown in FIG. 4A). Prior to game play, the top locking cover of the first securing device 124*a* is opened, and balls are inserted through a top opening below the first securing device 124*a*. The top locking cover is then locked during a game session to ensure that balls are not added to, or removed from, the mixing chamber 102.

Referring to FIG. 2D, there is shown a bottom view of the exterior of the automated gaming device. A second securing device 124*b* includes a bottom locking cover that releases the balls when the balls require removal for cleaning or replacement.

Figure 3A:
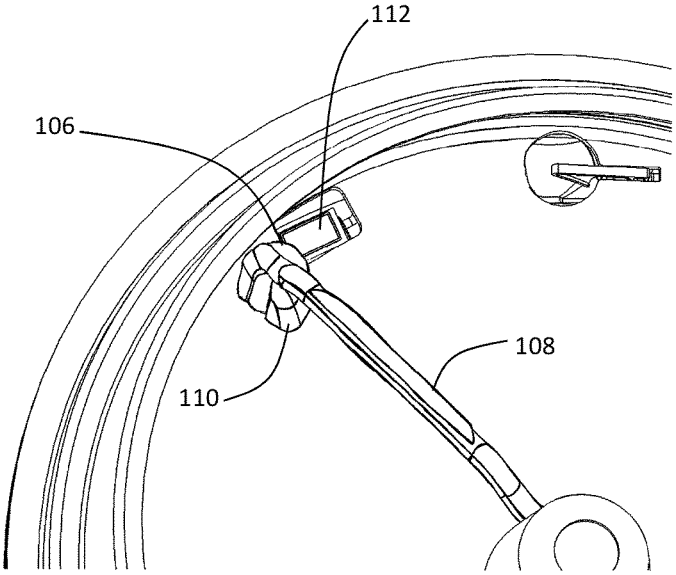
FIG. 3A shows an exploded view of the upper portion of the mixing chamber.

Referring now to FIG. 3A, there is shown an exploded view of the upper portion of the mixing chamber 102. The mixing arm 108 includes a ball 106 that is held by ball holder 110 before the ball is read by reader 112. In operation, the mixing arm 108 continues on its circular trajectory after capturing bingo ball 106 and delivers the ball 106 to the reader 112.

Figure 3B:
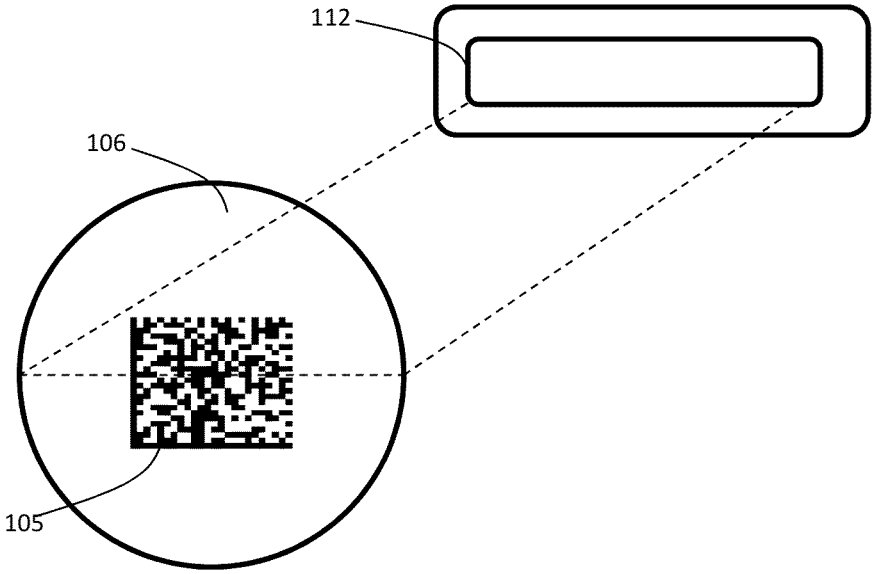
FIG. 3B shows an illustrative reader that is configured to read an identifier on the illustrative ball.

Referring now to FIG. 3B, there is shown an illustrative reader 112 that is configured to read a code or identifier 105 on the ball 106. In the illustrative embodiment, the ball 106 includes an identifier that uniquely identifies the ball such as a 2D data matrix barcode. For the illustrative bingo ball embodiment, the ball may also include a bingo letter and number. Typically, the balls are ping pong balls. Alternatively, the bingo balls may be composed of wood, rubber, or other such materials that allows the balls to easily mix.

In the illustrative embodiment, a 2D data matrix bar code reader 112 is used to read code 105. The illustrative data matrix code is a two-dimensional matrix barcode that includes black and white cells or modules arranged in either a square or rectangular pattern. The length of the encoded data depends on the number of cells in the matrix. Error correction codes are often used to increase reliability; even if one or more cells are damaged and unreadable, the message can still be read. A data matrix symbol can store up to 2,334 alphanumeric characters.

Alternative readers include, but are not limited to, barcode readers, QR code readers, RFID readers, smart card readers, a memory card reader, or other such readers. A barcode reader is an electronic device that can read printed barcodes. A QR reader can read a QR code or Quick Response Code, which is a matrix barcode. An RFID reader is an electronic device that reads a radio-frequency identification chip. A memory card reader is a device for communication with a smart card or a memory card. A magnetic card reader is a device used to read magnetic strip cards such as credit cards. A text-based card reader is a device used to scan and electronically save text such as alphanumeric text.

Figure 3C:
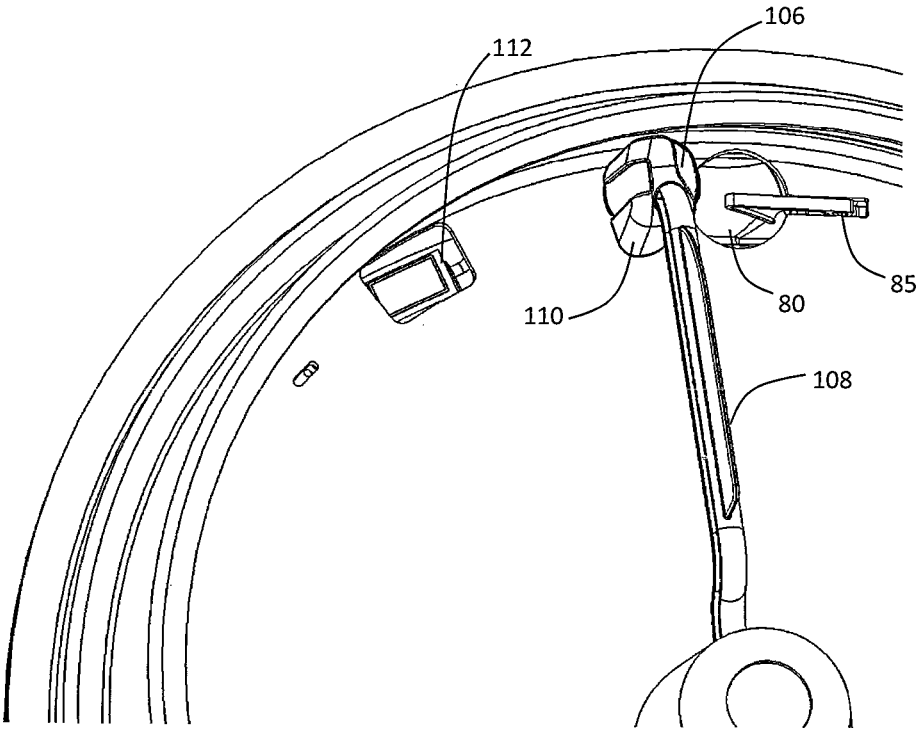
FIG. 3C shows an exploded view of the upper portion of the mixing chamber after an attempt has been made to read the identifier of the ball.

Referring now to FIG. 3C, there is shown an exploded view of the upper portion of the mixing chamber after an attempt has been made to read the identifier of the ball. After the reader 112, attempts to read the identifier 105, the mixing arm 108 moves along a circular trajectory toward a ball capture arm 85. If the ball is successfully read, the ball capture arm 85 is configured to force the captured ball 106 out of ball holder 110 and into ball capture channel 80. The captured bingo ball then travels through ball capture channel 80 into tube 114.

In the illustrative embodiment, the ball capture channel 80 is fixedly coupled to the top end of tube 114 (shown above). The ball capture arm 85 rejects balls from entering tube 114 when the ball capture arm 85 is in a closed position. In operation, an illustrative staging solenoid pushes the ball capture arm 85 into an open position that allows captured bingo balls to enter tube 114. After the captured bingo balls enter tube 114, the illustrative staging solenoid returns to the initial position and the ball capture arm 85 returns to a closed position.

After an illustrative ball holder captures a ball from the mixing chamber, the ball's unique identifier is read by the reader. In the illustrative embodiment, the arm rotates in a clockwise manner and a first attempt is made to read the ball in the ball holder. If the ball identifier is successfully read by the reader, then the ball enters the tube. However, if the first attempt to read the ball identifier is unsuccessful, then the arm is rotated counterclockwise to a second read attempt position and then the arm is rotated clockwise for a second read attempt. Typically, the counterclockwise and then clockwise rotation causes the surface of the ball to move, thereby changing the position of the ball so that one of the illustrative ball identifiers may be read by the reader. If the reader is unable to read the ball after multiple attempts, then a manual read process may be initiated, in which a person monitoring the game manually inputs the ball number into the ball delivery device or system.

Figure 4A:
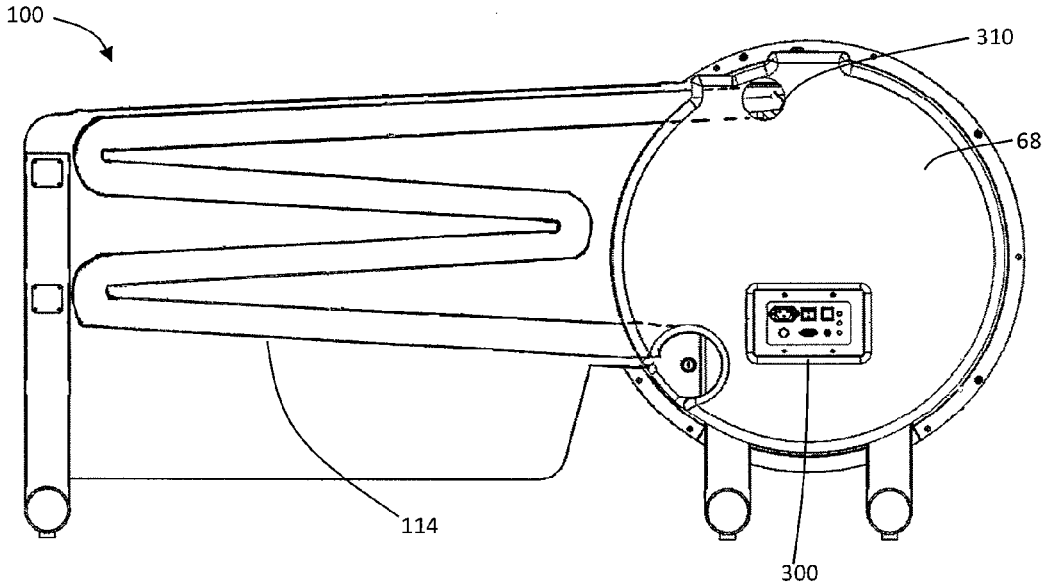
FIG. 4A shows back cover of the illustrative automated gaming device.
Figure 4B:
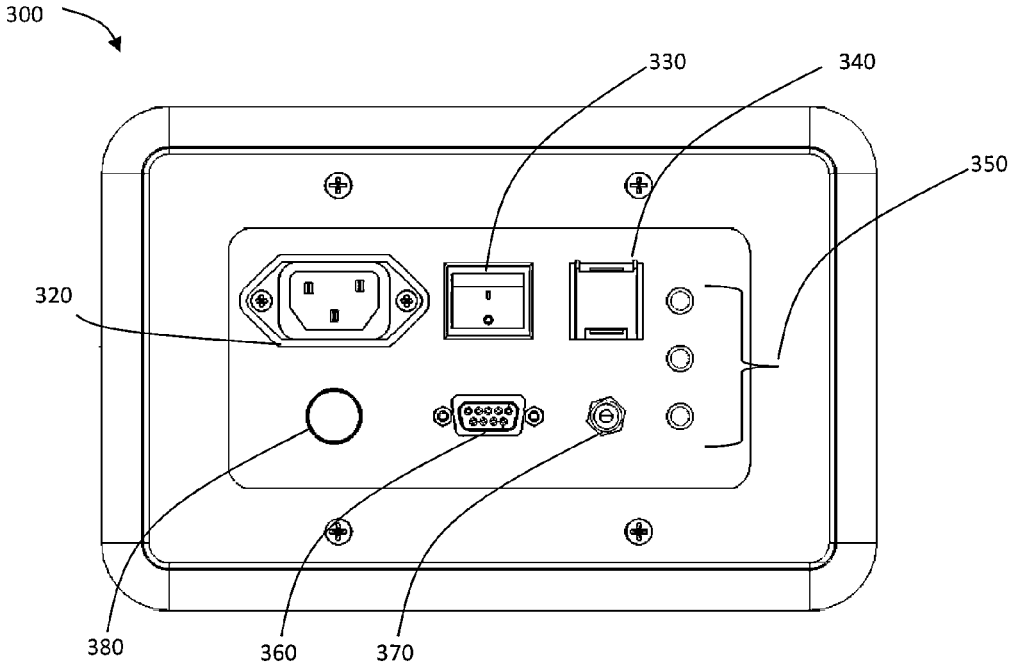
FIG. 4B shows an exploded view of the wired connections on the back cover.

Referring now to FIG. 4A, there is shown back cover 68 of the illustrative automated gaming device 100. The wired connections 300 and viewing window 310 are also shown. An exploded view of the wired connections 300 is shown in FIG. 4B. The wired connections include a grounded socket 320 that is configured to receive a power supply cord. A master power supply on/off switch 330 is shown. Also shown is a reset button 340. Additionally, indicator LEDs 350 are shown. An audio output 370 is also shown that would be used for a keno game session. A host game connects with serial port 360. An illustrative fuse 380 is also on the back cover. The wired connections are not limited to those depicted in the illustrative embodiment, and may include other wired connections including, but not limited to USB, firewall, Ethernet, VGA ports, LAN ports, digital video interface, HDMI, s-video, and other such computer connections. Additionally, the system supports integration with an Uninterruptible Power Supply (UPS) and other such auxiliary battery and back-up systems.

Figure 5:
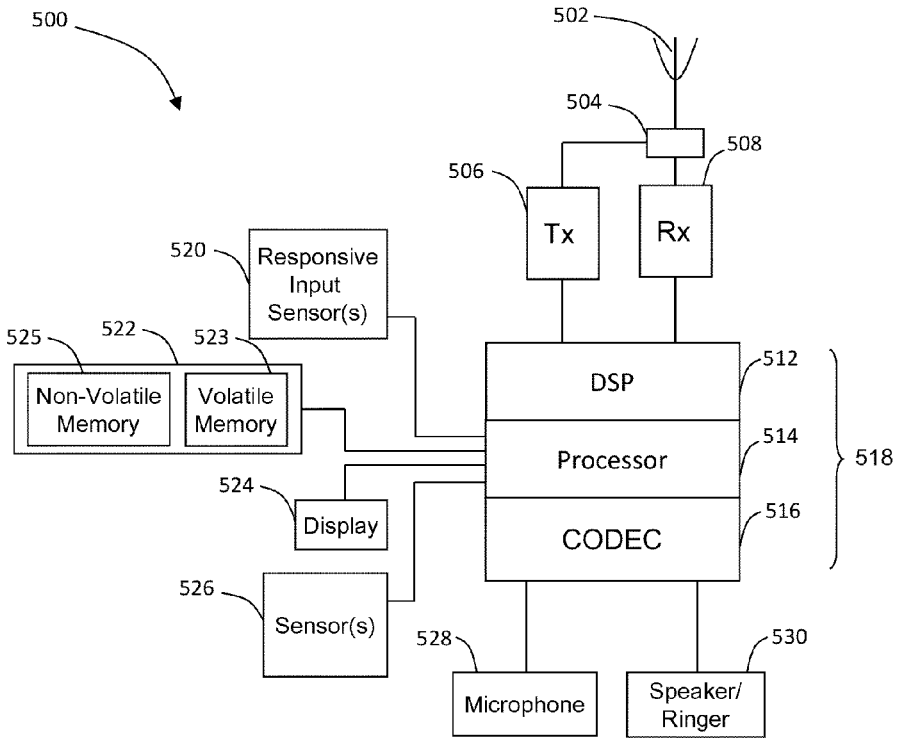
FIG. 5 shows the electrical components for an illustrative wireless device that displays the user interface.

Referring to FIG. 5, there is shown the electrical components for an illustrative wireless device 500 that displays the user interface shown in FIG. 6 below. For purposes of this patent, the illustrative wireless device 500 is a multimode wireless device that comprises a first antenna element 502 that is operatively coupled to a duplexer 504, which is operatively coupled to a multimode transmitter module 506, and a multimode receiver module 508.

An illustrative control module 518 comprises a digital signal processor (DSP) 512, a processor 514, and a CODEC 516 that are communicatively coupled to the transmitter 506 and receiver 508. It shall be appreciated by those of ordinary skill in the art that the transmitter module and receiver module are typically paired and may be embodied as a transceiver. The illustrative transmitter 506, receiver 508, or transceiver is communicatively coupled to antenna element 502.

The DSP 512 may be configured to perform a variety of operations such as controlling the antenna 502, the multimode transmitter module 506, and the multimode receiver module 508. The processor 514 is operatively coupled to a responsive input sensor 520, such as a keypad or a touch screen. The processor 514 is also operatively coupled to a memory 522, a display 524, and a sensor 526. The sensor 526 may be used to determine a GPS location for the illustrative wireless device.

Additionally, the processor 514 is also operatively coupled to the CODEC module 516 that performs the encoding and decoding operations and is communicatively coupled to a speaker 530, and a microphone 528. The CODEC module 516 is also communicatively coupled to the display 524 and provides the encoding and decoding operations for video.

The memory 522 includes two different types of memory, namely, volatile memory 523 and non-volatile memory 525. The volatile memory 523 is computer memory that requires power to maintain the stored information, such as random access memory (RAM). The non-volatile memory 525 can retain stored information even when the wireless communication device 500 is not powered up. Some illustrative examples of non-volatile memory 525 include flash memory, ROM memory, and hard drive memory.

Wireless device 500 may be a smartphone, mobile handset, mobile phone, wireless phone, portable cell phone, cellular phone, portable phone, a personal digital assistant (PDA), a tablet, a portable media device, a wearable computer, or any type of mobile terminal which is regularly carried by an end user and has all the elements necessary for operation in a wireless communication system. The wireless communications include, by way of example and not of limitation, CDMA, WCDMA, GSM, UMTS, or any other wireless communication system such as wireless local area network (WLAN), Wi-Fi or WiMAX.

Figure 6:
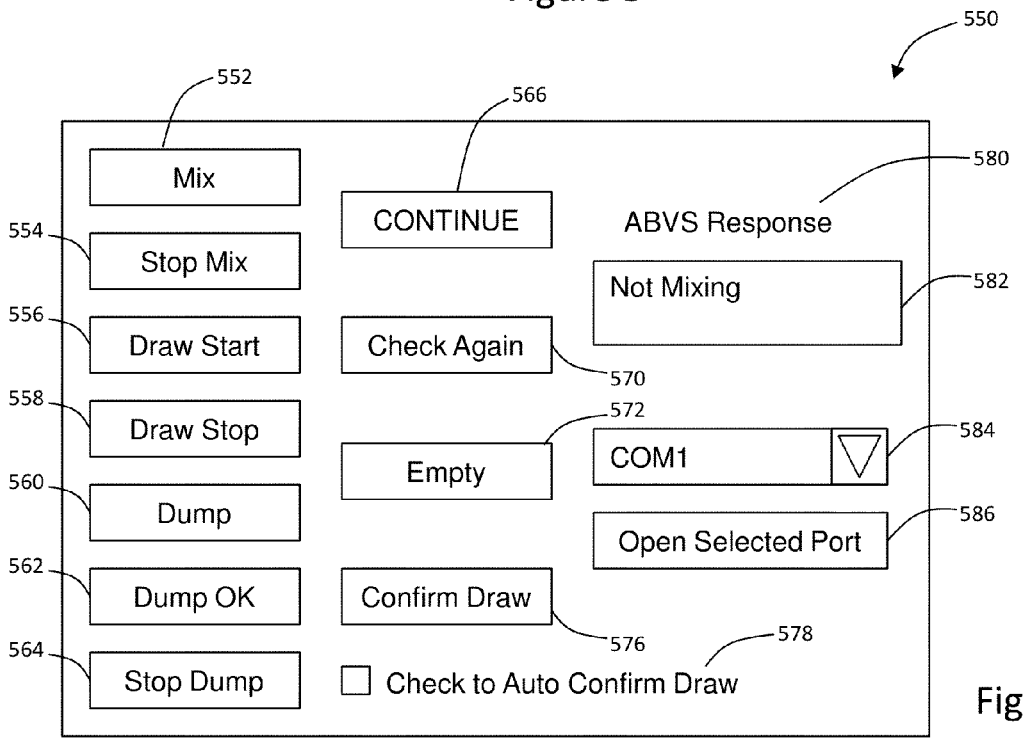
FIG. 6 shows an illustrative user interface that controls the automated gaming system.

Referring now to FIG. 6, there is shown an illustrative user interface 550. The user interface 550 is associated with an illustrative bingo game. Before starting a bingo game session, an illustrative bingo worker may mix the balls 123 in the mixing chamber 102 by hitting the "Mix" button 552. A "Stop mix" button 554 enables the bingo operator to stop the balls from mixing. The mixing process may be initiated independently of the bingo drawing process to allow players time to take a break during a game session or prior to beginning a game session.

A game session is initiated when balls are drawn from mixing chamber 102 by having the bingo worker hit the "Draw Start" button 556. The game session may be paused or ended when the operator hits the "Draw Stop" button 558.

At the end of the game session, the balls stored in tube 114 are released back into the mixing chamber. The balls stored in the tube 114 are released when the bingo worker hits the ball "Dump" button 560. If the ball dump is successful, then the bingo worker hits the "Dump OK" button 562. If the ball dump is not successful, then the bingo worker may have to hit the "Stop Dump" button 564. After the ball dump has been successfully completed, the bingo worker may proceed by starting a new game session.

The game session includes a plurality of game events. One such set of game events includes drawing one ball at a time. The bingo worker has the opportunity to manually confirm the drawing of each ball during each game event. During the manual confirmation process, the bingo worker has a variety of options available to him or her including checking the reading of ball again 570, identifying that the ball holder is empty 572, and confirming that the drawn ball was read 576. After making the appropriate selection, the bingo worker may then proceed to hit the "Continue" button 566 so that the game session may continue after the particular game event problems have been resolved.

Alternatively, the bingo worker may elect to avoid the manual confirmation process and check the auto confirm draw feature 578 that enables the system to perform the confirmation process for each ball drawing.

The illustrative user interface 550 also displays a game event state in window 582. The game event state 582 for the particular embodiment may also be referred to, for illustrative purposes only, as the Automated Bingo Video System Response 588 that may be presented in a separate video display (not shown). The display is configured to interface with the automated gaming device with one of the selected ports 586 such as a COM1 port 584.

Figure 7:
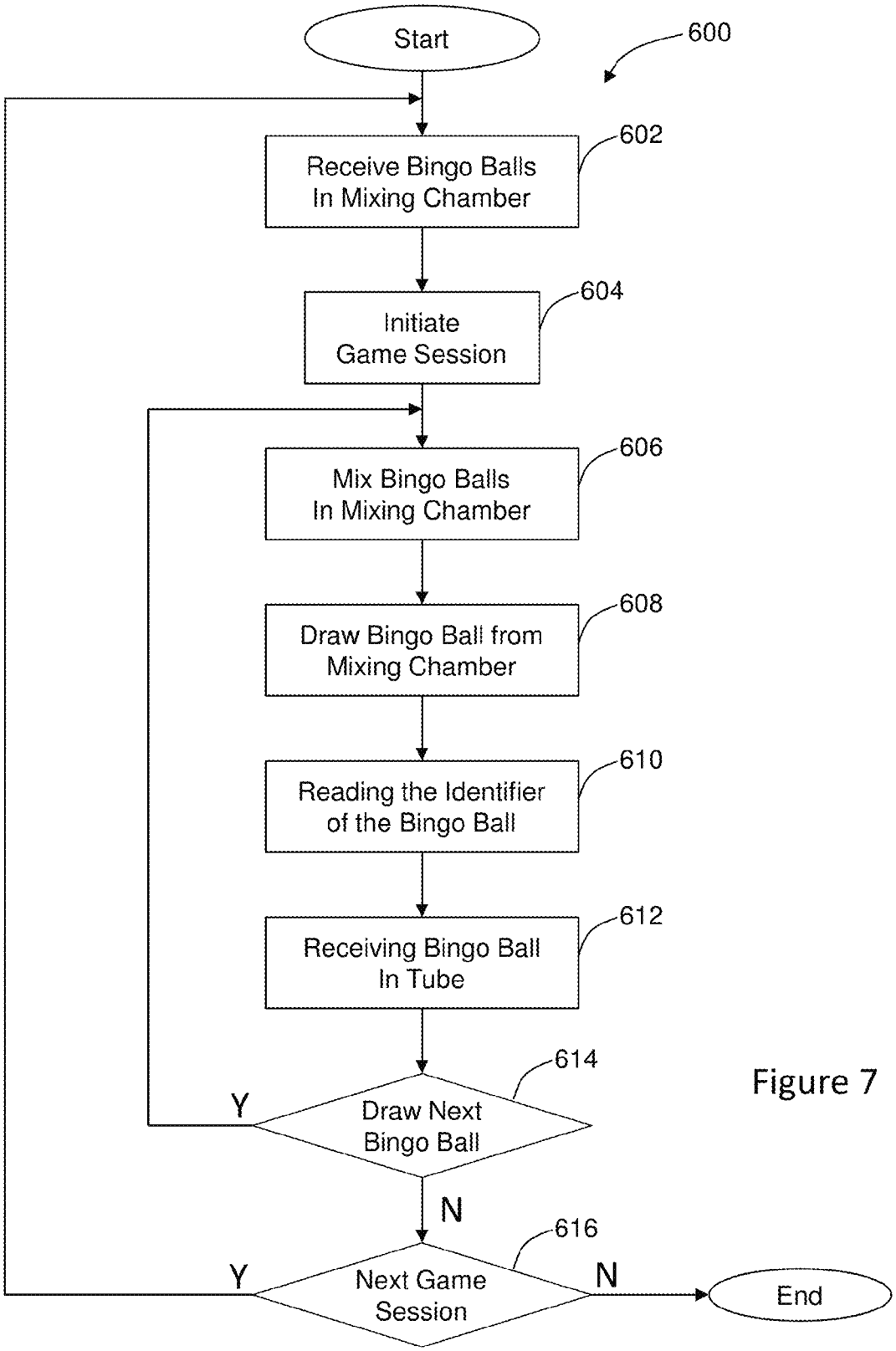
FIG. 7 shows a method for operating an automated gaming device housing a plurality of balls.

Referring now to FIG. 7, there is shown a method 600 for operating an automated gaming device housing a plurality of balls. The method begins at block 602 where the balls are received in a mixing chamber.

The illustrative automated device includes a securing component 124 that controls access to the balls housed in the automated gaming device. In an illustrative embodiment, the balls are locked within the automated gaming device during game play, and between game sessions to prevent tampering, such as the introduction and removal of balls 123 from the mixing chamber 102.

At block 604, the game session is initiated. In the illustrative embodiment, the game session is initiated when at least one instruction on a user interface is received. For example, the user instruction to draw start 556 (shown in FIG. 6) is received by the user interface and may start the illustrative game session. As described above, a variety of instructions may be received from the user interface that controls the game session and the operations of the automated gaming device.

The game session begins when at least one game is selected. By way of example and not of limitation, the illustrative game is a bingo game. However, other games may also be played on the ball delivery gaming device including lottery games, keno games, online bingo games, pakapoo, and other such lottery-style games. More generally, a lottery-style game includes a plurality of players that each receive a ticket or card and then await a random drawing of a "symbol" to determine whether there is a match between the player's ticket or card, and the randomly selected symbol(s). If there are sufficient matches between the randomly selected symbols and symbols on the player's ticket or card, then the first player to achieve a match according to the game rules is awarded a prize. By way of example and not of limitation, the symbols are numbers, but they may also be images, alphabetic symbols, alphanumeric symbols, or any combination thereof.

As previously described, there is a variety of different types of bingo games and in the illustrative embodiment presented above, the game session ends when a player obtains a first "Bingo" according to the rules of the bingo-style game. The illustrative Bingo game presented herein may also be applied to various forms of bingo including online games, numbers games, daily or weekly draws, and/or scratch card games. Illustrative forms of bingo include U-Pick'Em Bingo, Quick Shot bingo, Bonanza bingo, horse racing bingo, table bingo, and electronic bingo.

In alternative bingo embodiments, there may be a variety of different prizes awarded for different types of Bingo. For example, a first prize may be awarded for a first Bingo, a second prize for a second Bingo, and a third prize is awarded for a blackout Bingo. Thus, the game session would not end until the blackout Bingo award is obtained.

The method continues to block 606 where the balls are mixed in the mixing chamber. In operation, the automated gaming device rotates the illustrative mixing arms 108 and mixes the balls in a random manner. Alternatively, a blower may be used instead of the mixing arms. In yet another alternative embodiment, a combination of a blower and at least one mixing arm may also be employed.

At block 608, one ball is drawn from the mixing chamber. In the illustrative embodiment one of the mixing arms 108 randomly draws a single ball. Thus, in the illustrative bingo game embodiment, one ball is drawn at a time. In alternative embodiments, multiple balls may be drawn at a time.

At block 610, the identifier for the drawn ball is read by the automated gaming device. During the random selection of the ball, the illustrative arm mixes the remaining balls in the mixing chamber. More specifically, the combination of the arm and fin mix the balls in the chamber. In the illustrative embodiment, three arms are fixedly coupled to a hub that is operative coupled to a motor that turns the hub and three arms.

In operation, the randomly selected ball is drawn with the ball capture arm 85. The randomly selected bingo ball 106 continues to travel on the circular trajectory past ball reader 112 and is then scanned or read.

If the scanned ball is successfully read by reader 112, then the method reports the ball identification code to memory 522. The captured ball is then placed into ball capture channel 80.

At block 612, the selected ball that is accepted by the ball capture channel is then received in the tube 114. The tube holds the randomly selected bingo balls until completion of the game session. The captured ball then travels down tube 114 until stopped by the illustrative ball release arm 98 or by another bingo ball that has already entered tube 114. By way of example and not of limitation, the staging solenoid activates ball capture arm 85 to move from closed position to open position, and captured ball 106 enters the tube 114 and travels down tube 114 until stopped by ball release arm 98, or by a ball 106 which previously entered tube 114.

In the illustrative embodiment, the tube is disposed on a vertical panel that is adjacent to the mixing chamber. The vertical panel includes the tube 114 that receives the selected bingo balls. Additionally, the vertical panel enables the players to view the selected bingo balls.

At decision diamond 614, the determination is made of whether to draw the next ball. If the game session has not ended, then the method proceeds to wait for a user instruction to randomly select the next ball. Additionally, the automated gaming device may be configured to automatically select the next ball, without the need for a person to initiate the selection of the next ball. Additionally, the system and method presented herein can operate without a caller or other such person that reads the ball symbol.

At decision diamond 616, the determination is made of whether to start the next game session. If the determination is made to start another game session, then balls held in the tube are released into the mixing chamber.

In an alternative embodiment, the symbol corresponding to the ball may be "read" or determined by a video camera or still camera having the necessary optical character recognition module that can capture the appropriate images and determine the ball symbol corresponding to the particular ball. In this alternative embodiment, a ball identifier is not imprinted on the balls and the ball only has a number. Since a camera may not be able to properly read the ball number, a plurality of cameras may be used, in which each camera has a different view of the bingo ball number. The camera may be configured to interface with an optical character recognition module (not shown) that can determine the bingo number. Typically, a match may be required between each camera; however, there may be instances where a single reading by a camera may be sufficient to determine the bingo number imprinted on the bingo ball.

In yet another illustrative embodiment, a combination of a video camera and a reader may be used. The ball number may be optically determined with the video camera and validated with a reader that can read a particular identifier. The ball number is then reported to memory 522 and checked against ball identification code at step 610.

It is to be understood that the detailed description of illustrative embodiments are provided for illustrative purposes. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A ball delivery device housing a plurality of balls for a game session, the ball delivery device comprising:

a mixing chamber that receives the plurality of balls for the game session;

at least one instruction to start the game session, the game session including a plurality of game events, in which a smaller group of game events are each associated with drawing at least one ball from the mixing chamber during the game session;

an identifier on each ball that uniquely identifies each ball;

at least one arm mixes the balls in the mixing chamber;

a ball holder disposed on the arm, wherein the ball holder receives a single ball that is randomly selected from the mixing chamber;

a reader that reads the identifier of the ball selected by the ball holder; and a tube that receives each selected ball and holds the selected balls after the identifier reads the ball and until completion of the game session.

2. The ball delivery device of claim 1 wherein the arm includes a fin that mixes the balls in the mixing chamber and the ball holder receives the single ball, when the arm turns.

3. The ball delivery device of claim 2 wherein the arm receives one ball and mixes the balls in the mixing chamber when the arm turns clockwise, and the arm mixes the balls in the mixing chamber when the arm turns counterclockwise.

4. The ball delivery device of claim 1 further comprising a plurality of arms that are fixedly coupled to a hub that is operatively coupled to a motor that turns the arms.

5. The ball delivery device of claim 1 further comprising a release mechanism that releases the balls held in the tube after the completion of each game session.

6. The ball delivery device of claim 5 further comprising a vertical panel adjacent to the mixing chamber, wherein the vertical panel includes the tube that receives the selected balls.

7. The ball delivery device of claim 6 further comprising a securing device that controls access to the balls housed in the ball delivery device so that the balls cannot be accessed during the game session.

8. The ball delivery device of claim 7 further comprising a static removal component that includes an ION CORD™.

9. The ball delivery device of claim 6 further comprising a user interface that receives the at least one instruction for initiating the game session.

10. The ball delivery device of claim 1 wherein the game session includes a bingo game session with a plurality of bingo game events.

11. The ball delivery device of claim 1 wherein the game session includes a keno game session with a plurality of keno game events.

12. A method for operating a ball delivery system housing a plurality of balls for a game session, the method comprising:

receiving the plurality of balls in a mixing chamber for the game session;

receiving at least one instruction to start the game session, in which the game session includes a plurality of game events, in which a smaller group of game events are each associated with drawing a ball from the mixing chamber during the game session;

identifying each drawn ball with an identifier that uniquely identifies the ball;

mixing the balls in the mixing chamber with at least one arm;

enabling a ball holder disposed on the arm to receive a single ball that is randomly selected from the mixing chamber;

reading the identifier of each ball that is selected by the ball holder; and receiving each selected ball in a tube that holds the selected balls until completion of the game session.

13. The method for operating the ball delivery system of claim 12 further comprising mixing the balls in the mixing chamber with the arm that further includes a fin that mixes the balls in the chamber and the ball holder receives the single ball, when the arm turns.

14. The method for operating the ball delivery system of claim 13 further comprising mixing the balls in the mixing chamber and selecting balls in the mixing chamber when the arm turns clockwise, and mixing the balls in the mixing chamber when the arm turns counterclockwise.

15. The method for operating the ball delivery system of claim 12 further comprising a plurality of arms that are fixedly coupled to a hub that is operatively coupled to a motor that turns the arms.

16. The method for operating the ball delivery system of claim 12 further comprising releasing the balls held in the tube after the completion of each game session.

17. The method for operating the ball delivery system of claim 16 further comprising receiving the selected balls with a vertical panel adjacent to the mixing chamber that includes the tube that receives the selected balls.

18. The method for operating the ball delivery system of claim 17 further comprising controlling access to the balls housed by the ball delivery system with a securing device that prevents access to the balls during the game session.

19. The method for operating the ball delivery system of claim 18 further comprising removing a static charge with a static removal component that includes an ION CORD™.

20. The method for operating the ball delivery system of claim 17 further comprising receiving the at least one instruction for initiating the game session with a user interface.

21. The method for operating the ball delivery system of claim 12 wherein the game session includes a bingo game session with a plurality of bingo game events.

22. The method for operating the ball delivery system of claim 12 wherein the game session includes a keno game session with a plurality of keno game events.

* * * * *